United States Patent [19]

Kuhlman

[11] 4,220,054

[45] Sep. 2, 1980

[54] CRANK HANDLE ASSEMBLY

[75] Inventor: Lorraine O. Kuhlman, Monroe City, Mo.

[73] Assignee: Kuhlman Diecasting Company, Monroe City, Mo.

[21] Appl. No.: 9,392

[22] Filed: Feb. 2, 1979

[51] Int. Cl.[2] ..... B25G 3/00

[52] U.S. Cl. ..... 74/545; 16/121

[58] Field of Search ..... 74/545; 16/110 R, 121

[56] References Cited

U.S. PATENT DOCUMENTS

| | | | |
|---|---|---|---|
| 1,611,549 | 12/1926 | Moore | 16/110 R |
| 3,071,023 | 1/1963 | Herr et al. | 16/121 X |
| 4,117,568 | 10/1978 | Bullock | 74/545 X |

FOREIGN PATENT DOCUMENTS

| | | | |
|---|---|---|---|
| 1655047 | 12/1970 | Fed. Rep. of Germany | 74/545 |
| 2218505 | 10/1973 | Fed. Rep. of Germany | 74/545 |

*Primary Examiner*—Andrew V. Kundrat

*Attorney, Agent, or Firm*—Fishburn, Gold and Litman

[57] ABSTRACT

A crank handle assembly for mounting onto an end of a rotatable shaft of a window moving or carriage mechanism for raising and lowering a window of a vehicle such as an automobile or truck. The assembly includes a crank arm having at one end a head for engaging the carriage mechanism shaft and at the other end a knob base with an integral circular knob extending therefrom. The knob has an outwardly extending side surface and an end surface, the side surface being separated from the knob base by a groove forming a rounded shoulder facing the crank arm. A cylindrical cap or handle of resilient plastic material for fitting onto the knob includes an open end, a side wall and a closed end wall defining a well for receiving the knob. The open end has an inwardly extending annular ring or flange for positioning with the groove and engaging the shoulder. The cap is sized so that the closed end wall, the side wall and the ring engages corresponding portions of the knob and thereby effect a secure, wobble-free rotative connection for gripping the cap and rotating the crank arm.

3 Claims, 4 Drawing Figures

CRANK HANDLE ASSEMBLY

This invention relates to a crank handle and in particular to a crank handle for use with window moving or carriage mechanisms for vehicles such as automobiles and trucks.

Various cranks and gripping knob or handle arrangements are known in the art. In the usual mode of construction, a knob is connected to the crank arm by a pin or bolt which, for example, is peened over at one or both ends so that the knob or handle rotates relative to the crank arm. The connection between bolt or peened shaft and the knob loosens or wears with use to the extent that the knob wobbles relative to the crank arm as it is rotated. In fact, after extended use the knob and crank arm may separate, requiring purchase of an entire new crank arm and knob assembly.

Moreover, such a crank arm and knob requires a number of machining operations and assembly steps which add to the cost of the finished crank handle assembly.

The principal objects of the present invention are: to provide a crank handle assembly for use with vehicle window moving or carriage mechanisms; to provide such a crank structure having a handle mounting knob integrally formed therewith; to provide such an assembly wherein a cap for gripping fits over the knob in secure, wobble-free rotative engagement; and to provide such an assembly which is relatively inexpensive, sturdy and efficient in use and particularly well adapted for the intended purpose.

Other objects and advantages of this invention will become apparent from the following description taken in connection with the accompanying drawings wherein are set forth, by way of illustration and example, certain embodiments of this invention.

Figure 1:
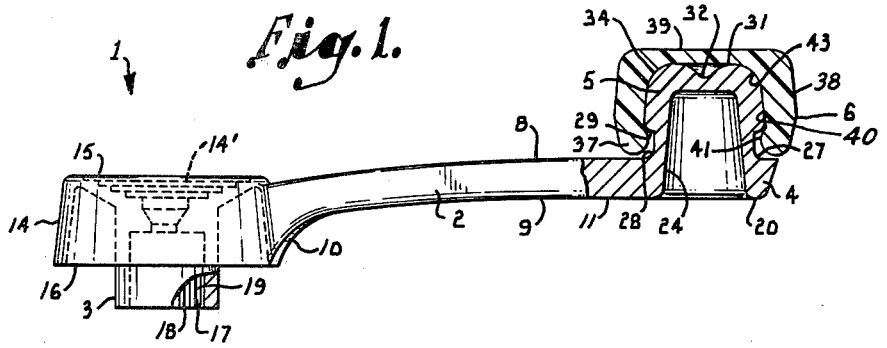
FIG. 1 is a side elevational view of a crank handle assembly embodying the present invention and is shown with a portion thereof broken away.

Referring to the drawings in more detail:

As required, detailed embodiments of the present invention are disclosed herein, however, it is to be understood that the disclosed embodiments are merely exemplary of the invention which may be embodied in various forms, therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally indicates a crank handle assembly embodying the present invention and adapted for mounting onto an end of a rotatable shaft of a window moving or carriage mechanism for raising and lowering a window of an automobile or truck (not shown). The assembly includes an elongate, rigid crank arm 2 with means 3 on one end thereof for engaging a rotatable shaft of a carriage mechanism and a knob 5 on the other end of the arm 2 for mounting a handle or cap 6. The knob 5 is preferably integrally formed with the crank arm 2 and a cap or handle 6 adapted for grasping and having internal dimensions commensurate with the knob 5 fits over the same in secure, wobble-free, rotative engagement for rotating the crank 2 and operating the window moving mechanism.

Figure 2:
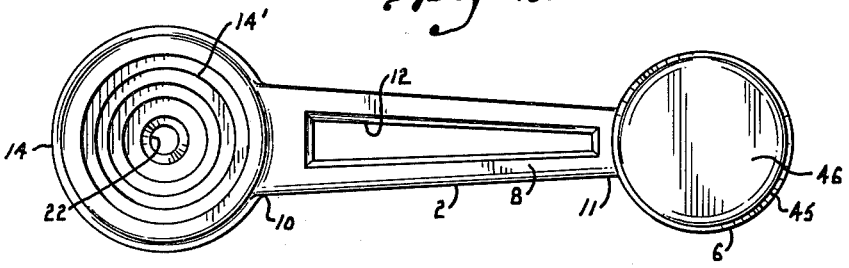
FIG. 2 is a plan view of the crank handle assembly.
Figure 3:
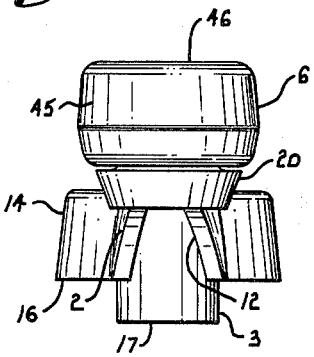
FIG. 3 is an end elevational view of the crank handle assembly.

The crank arm 2, shaft engaging means 3 and knob 5 are preferably integrally formed, such as by diecasting, of a suitable material such as aluminum, zinc alloy, or plastic which is relatively easily formed and has sufficient rigidity and durability for the intended usage. In the illustrated example, the crank arm 2 has opposed surfaces 8 and 9 with spaced, opposite end portions 10 and 11 joining the shaft engaging means 3 and the knob 5. For decorative purposes and reduction of material, the crank arm 2 narrows from the end portion 10 to the end portion 11, FIG. 2, and includes an elongate central opening 12.

A circular head 14 is connected to the end portion 10 and has opposed surfaces 15 and 16, the surface 15 having a plurality of decorative concentric recesses forming rings 14' thereon, said recesses accommodating the head of a crank fastener (not shown). The head 14 is preferably hollow and the shaft engaging means 3 is a boss or hub member extending axially beyond the surface 16 and, has a socket 17 with an open end 18 and with a plurality of interior splines 19 for fitting and keying same onto the shaft end (not shown). A central bore 22 extends through the head 14 for a fastener, such as a screw, for securing the crank to the shaft end (not shown).

The other end portion 11 is connected to a circular base 20 for the knob 5 has an outer surface sloping inwardly and away from the arm surface 8. The knob 5 is integral with the arm and projects from the surface 8 in concentric location to the base 20. Preferably, the knob 5 includes a well or cavity 24 open to the surface 9 of the base 20.

Figure 4:
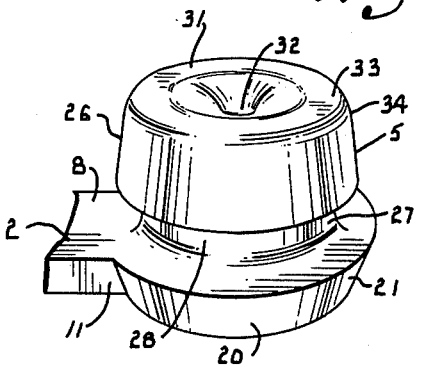
FIG. 4 is an enlarged fragmentary, perspective view of an end portion of the crank handle and showing the handle mounting knob, the cap therefor being removed for purposes of illustration.

In the illustrated example, FIG. 4, the knob 5 is circular and includes a wall portion with a peripheral surface 26 inclined slightly axially inward away from the base, said peripheral surface being spaced from the base 20 by a groove 27 extending therearound. In transverse section, FIG. 1, the groove 27 has a rounded portion 28 at the juncture of the groove 27 with the base top surface 8 and a rounded portion 29 merging with the peripheral surface 26, thereby defining a shoulder facing the base 20 for engagement with the cap 6 as described below.

The surface 26 merges with an end surface 31 having a center depression or dimple 32, thereby forming a ring portion 33 around the end surface 31. The ring portion 33 presents a curved portion forming a circular line 34 defining an inner limit of contact of the cap 6 as described below.

The cup 6 is preferably of a synthetic resin having some resiliency, such as polyurethane, polyethylene or the like and is formed, as by molding, into a generally cylindrical shape having an open end 37, a side wall 38 and a closed end wall 39 arranged with dimensions associated with the knob wall portion 26 and upper end surface 31, thereby defining an interior opening or well 40 sized for receipt of the knob 5. The open end 37 has an annular inwardly extending holding ring or flange 41 for insertion into the groove 27 and rotative engagement with the groove rounded portion 29. The side wall 38 and end wall 39 have inner surfaces curvingly merging to form a bearing surface 43 for rotative engagement with the peripheral surface 26 and surface of the ring 33 to the line 34. Preferably, the inner surface of the side wall 38 has depth dimension commensurate with the length dimension of the knob peripheral wall portion 26 whereby the cap 6 is retained on the knob 5 with a tension maintaining the holding ring or flange rotatably engaged with the shoulder or rounded portion 29 of the groove 27 and the bearing surface 43 rotatably engaged with the peripheral surface 26 and the bearing surface of the ring 33 the engagement of the surfaces is such that the bearing surface 43 and peripheral surface 26 act as a radial bearing and the ring or flange 41 engaging the shoulder 29 and the engagement cap end wall surface with the ring 33 act as thrust bearings to substantially eliminate any relative endwise movement of the cap or handle 4 on the knob 5.

The resilient material of the cap 6 has a memory which permits a snap fit of the cap 6 over the knob 5 for secure, wobble-free rotative engagement when gripping the cap 6 and rotating the crank arm 2 and socket 17.

To aid grasping the cap 6, the exterior surface preferably has side wall ribs 45. Further, the end wall 46 has an attractive ornamental design.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A crank handle assembly comprising:

(a) an elongate crank arm having spaced end portions;

(b) means at one said end portions and extending therefrom for operatively connecting same to a mechanism operative in response to rotation of said means;

(c) a handle mounting knob at the other said end portion and extending therefrom in a direction opposite to said means, said knob having an end surface and a generally cylindrical outer surface and an annular groove between the said cylindrical outer surface and the crank arm with a merging surface between the groove and cylindrical outer surface defining a shoulder facing said crank arm;

(d) a handle of resilient material having a cavity therein opening at an end thereof with the other end closed and defining a substantially cylindrical inner surface, cavity end surface and an annular flange adjacent said open end forming a shoulder facing said end surface with the cavity of a shape and size for the handle to be engaged over said knob and rotatable thereon with the cavity cylindrical inner surface and end surface in bearing contact with the cylindrical outer surface and end surface respectively of the knob and the flange shoulder engaged with the shoulder of the knob to retain the handle on the knob;

(e) the shoulder forming merging surface between the groove and cylindrical outer surface of the knob is rounded;

(f) the cylindrical outer surface of the knob merges into the end surface thereof on a radius providing a rounded surface;

(g) the cavity in the handle has corresponding rounded surfaces where the cylindrical inner surface thereof merges into the shoulder of the annular flange and into the end surface respectively for bearing contact with the respective said merging rounded surfaces of the knob; and (h) said knob has an axial recess in the end thereof with the outer portion rounded and on the same radius as the rounded surface of the cylindrical outer surface and end surface of the knob.

2. A crank handle assembly as set forth in claim 1 wherein:

(a) said crank arm and knob are integral and said knob is hollow;

(b) said handle is in the form of a cap of resilient synthetic resin and is a snap fit on the knob.

3. A crank handle assembly as set forth in claim 2 wherein:

(a) said crank arm and knob are of cast metal;

(b) a portion of the cavity end surface is spaced from a portion of the recessed end surface of the knob.

* * * * *